United States Patent [19]

Fiore, Jr. et al.

[11] Patent Number: 4,601,069

[45] Date of Patent: Jul. 22, 1986

[54] WOMAN'S BARE MIDRIFF GARMENT

[76] Inventors: Fred W. Fiore, Jr.; Lee B. Fiore, Jr., both of 2477 NW. 89th Dr., Coral Springs, Fla. 33065

[21] Appl. No.: 672,623

[22] Filed: Nov. 19, 1984

[51] Int. Cl.[4] ..... A41D 1/18

[52] U.S. Cl. ..... 2/106

[58] Field of Search ..... 2/106, 69.5, 104, 105, 2/69; 128/435, 455

[56] References Cited

U.S. PATENT DOCUMENTS

| | | | |
|---|---|---|---|
| 1,489,904 | 4/1924 | Sobelman | 2/106 |
| 1,566,267 | 12/1925 | Bee | 128/455 |
| 1,987,954 | 1/1935 | Halpern | 2/106 |
| 2,441,274 | 5/1948 | Kay | 2/106 |

*Primary Examiner*—Doris L. Troutman

*Attorney, Agent, or Firm*—Melvin K. Silverman

[57] ABSTRACT

It is herein disclosed a woman's bare midriff garment. The garment includes an outer shell supported about the shoulders of the wearer; the outer shell normally aligns against the inner area of the neckline and the upper breast area, the outer shell hanging freely downward from breast, such hanging beginning at the upper and middle of the breast of the wearer. The garment also includes an inverted frusto-conical segment having a first radial and a second radial end, the first end being narrower than the second end, the first end including elastic adapted for the engagement of the torso of the wearer near the top of the rib cage but beneath the bottom of the breast, and the second end defining a hem near the bottom of the rib cage, the hem integrally secured to the lower-most edge of the downwardly hanging portion of the outer shell. There is thusly provided a bare midriff garment in the nature of a tank-top, particularly suited for athletic activity but which, nonetheless, will preserve the modesty of the wearer.

6 Claims, 5 Drawing Figures

WOMAN'S BARE MIDRIFF GARMENT

BACKGROUND OF THE INVENTION

This invention relates in general to ladies garments and, more particularly, to a new and improved bare midriff garment in the nature of a tank-top, half-shirt or cut-off tee shirt, sweat shirt or the like.

With the recent popularity in women's tank tops, cut-off shirts, and half-shirts, a need has developed for such an item that an athletic woman could wear, without a brassiere (hereinafter "bra"), and not be concerned with regard to a possible undesired exposure of the breasts in the course of vigorous activity.

Accordingly, the present invention is addressed to a stylish half-shirt garment not requiring the wearing of a bra therewith that will, nonetheless, preserve the wearer's modesty in the event of athletic activity involving abrupt upward or downward movement of the breasts.

The prior art in the present area is, to the knowledge of the inventor, reflected in only one patent, this being U.S. Pat. No. 4,440,174 (1984) to Cordova entitled "Woman's Garment".

SUMMARY OF THE INVENTION

The present invention is directed to a woman's bare midriff garment including an outer shell supported about the shoulders of the wearer, said outer shell normally lying against the area of the neckline and the upper breast of the wearer, said outer shell hanging freely downward from the breast, said downward hanging beginning at the nipple of the breast. Also included is an inverted frusto-conical segment having a first radial end and a second radial end, said first end being narrower than the second end, said first end including elastic means adapted for the engagement of the torso of the wearer near the top of the rib cage, and said second end defining a hem near the bottom of the rib cage, said hem integrally secured to the lower-most edge of said downwardly hanging portion of said outer shell. The resulting garment is a bare midriff garment in the nature of a half-shirt.

The general object of the present invention is to provide a bare midriff woman's half-shirt that will afford to the wearer a stylish garment having the comfort of bralessness while preserving the wearer's modesty in the event of vigorous activity that, absent said elastic means for engagement of the upper rib cage, might cause an undesirable exposure of the wearer's breasts.

It is another object to provide a bare midriff garment that will fully cover a bra, if worn, beneath such garment, throughout a wide range of movements by the wearer.

The above and yet further objects and advantages of the present invention will become apparent from the hereinafter set forth Detailed Description of the Invention, the Drawings and Claims appended herewith.

DETAILED DESCRIPTION OF THE INVENTION

Figure 1:
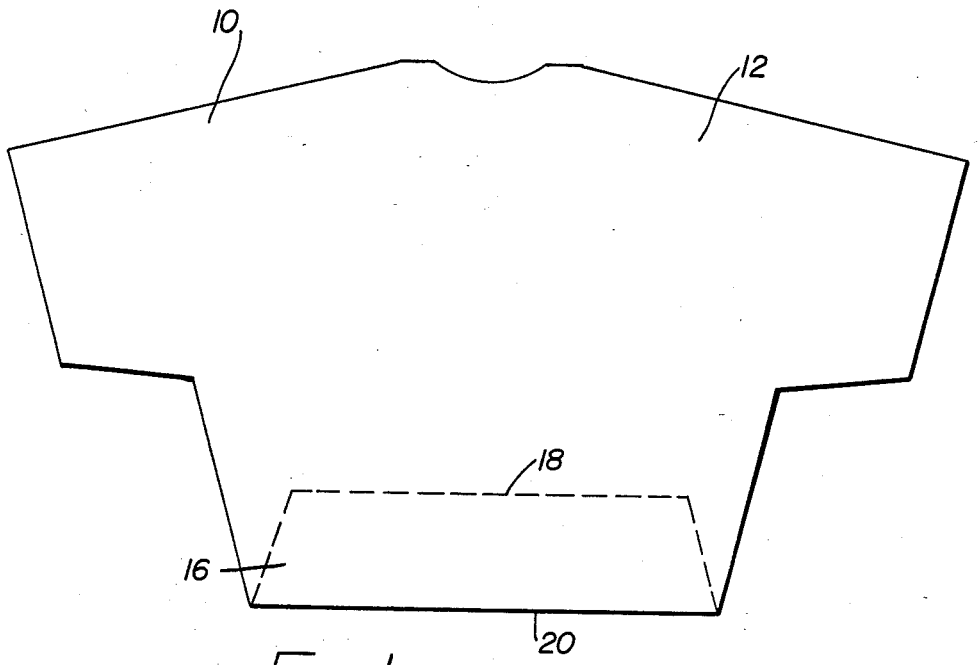
FIG. 1 is a conceptual schematic view of the present invention.

With reference to FIG. 1, there is shown a conceptual schematic view of the present invention in which is illustrated the garment 10 which includes an outer shell 12 and a frusto-conical segment 16 having a first radial end 18 and a second radial end 20.

Figure 2:
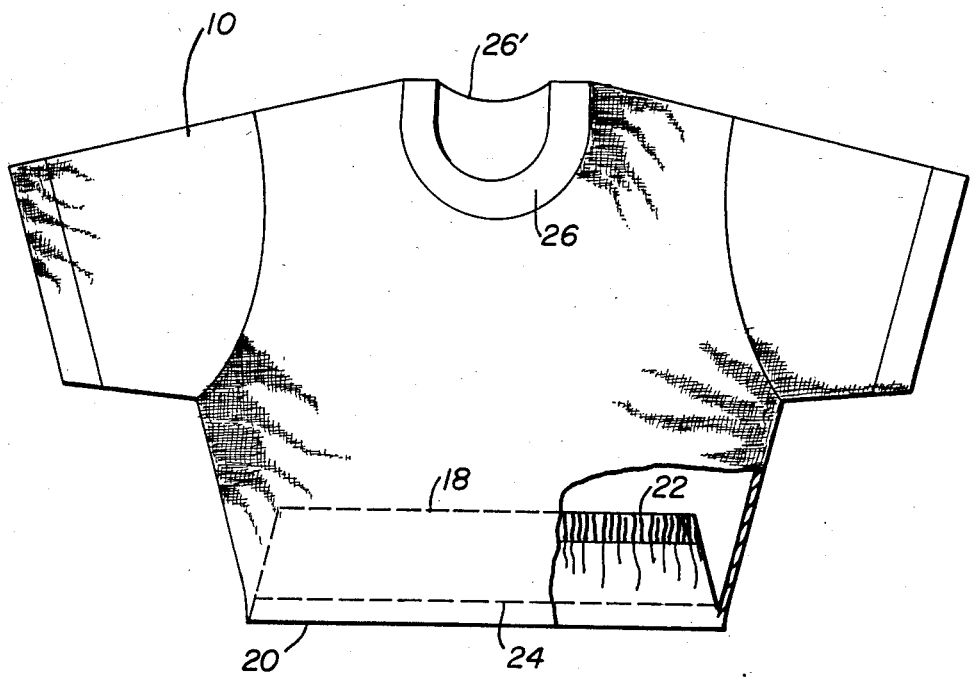
FIG. 2 is a front perspective view of the present invention.

As is noted more fully in FIG. 2, the first radial end includes elastic means 18 adapted for the engagement of the torso of the wearer near the top of the rib cage. See FIGS. 3 and 4.

The second radial end defines a hem 24 near the bottom of the rib cage. The hem 24 is integrally secured to the lowermost edge of the downwardly hanging portion of the outer shell 12. In connection therewith, it is noted that said outer shell would normally lie against the area of the neckline 26 and the upper breast area of the wearer. Therefrom (see FIG. 4), the outer shell will hang freely downward from the breast, said hanging area 14 beginning at about the nipple of the breast.

The hanging area 14 will continue until reaching the hem 24 which represents the point of joiner between the outer shell 12 and the frusto-conical segment 22.

Figure 5:
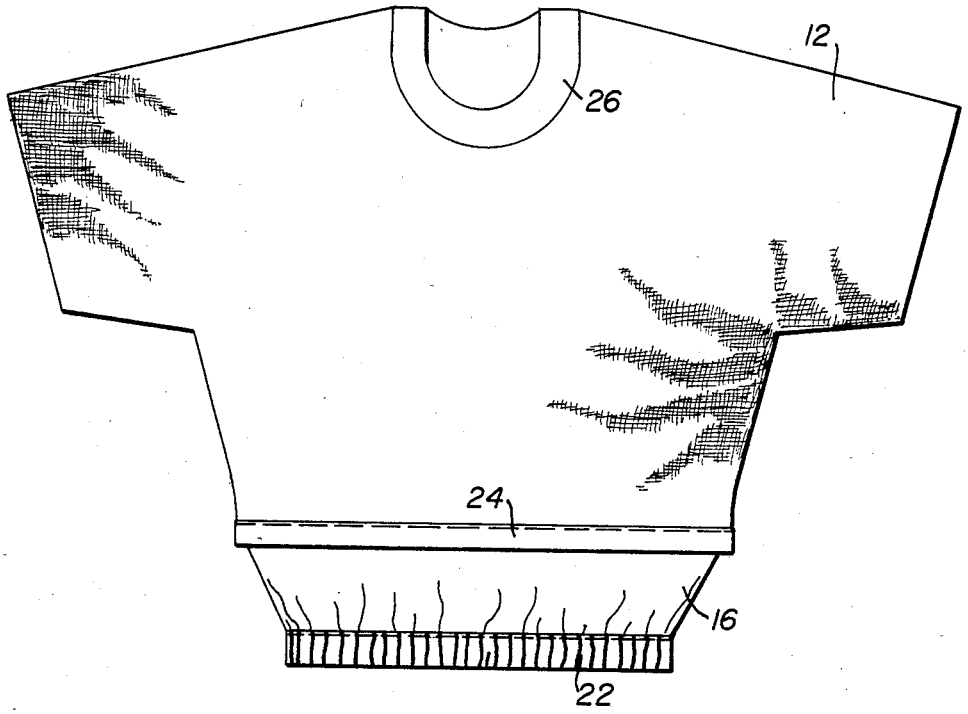
FIG. 5 is a front perspective view illustrating the appearance of the garment when not engaged with the body of the wearer.

In FIGS. 2 and 5, it is to be noted that neckline 26 represents a tee shirt-type neckline, while neckline 26 represents a crew neck-type neckline for the present garment 10.

Figure 4:
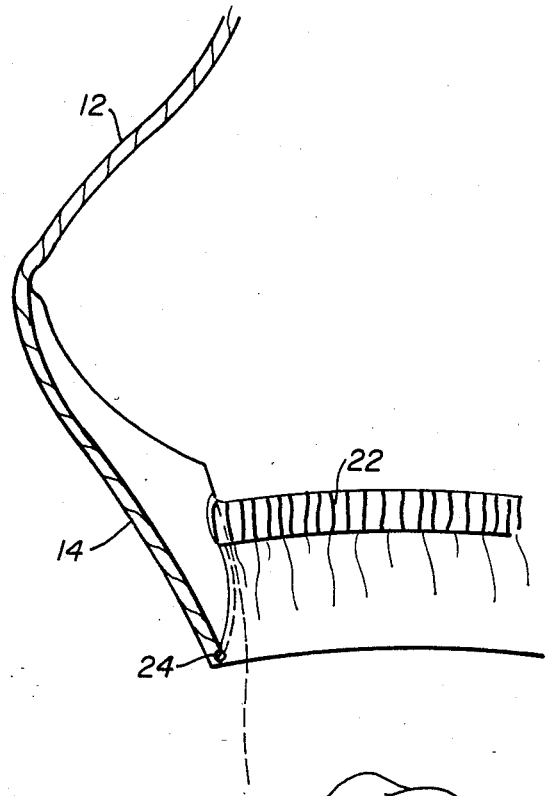
FIG. 4 is a cross-sectional schematic view illustrating the manner of engagement of the inventive garment with the body of the wearer.
Figure 3:
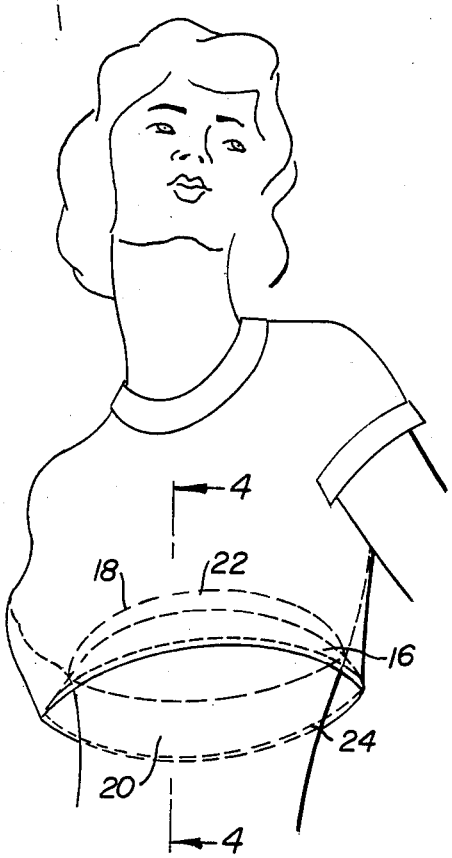
FIG. 3 is a perspective view illustrating the manner in which the present half-shirt garment may be worn.

It is, through FIGS. 3 and 4, to be appreciated that the elastic element 22 is adapted for engagement of the torso near the top of the rib cage but below the bottom of the wearer's breast, while the hem 24 will extend only to the area of the bottom of the rib cage or the diaphram, thereby affording the wearer a stylish bare midriff.

Through the above arrangement the lower breast is completely sealed to the body so that a woman involved in athletics or vigorous movements of any kind, or were she to bend over, would have no concern relative to undesired exposure of her breasts (or bra, if worn).

With regard to the neckline, two different necklines are shown in FIG. 2 and, it is to be appreciated, that the neckline may extend as far toward the breasts as the clavicle.

Through such combination of a relatively high neckline and a completely sealed lower bust area, the requirements of modesty are met while affording to the wearer suitable comfort and ease of motion.

It is to be also appreciated that the neckline may follow the approach disclosed in Cordova, cited above, which involves the usage of thin straps to suspend the outer shell 12 from the shoulders of the wearer.

The proposed garment may be made of cotton, in the nature of that used for a tee shirt. If a bulkier feeling is desired, a sweat-shirt, knubby-type cotton may be used.

Accordingly, while there has been herein shown and described the preferred embodiments of the present invention, the invention may be embodied otherwise than is herein specifically illustrated or described and that in such embodiments certain changes in the detail of construction, or in the form and arrangement of parts, may be made without departing from the underlying ideas or principles of this invention, within the scope of the appended claims.

We claim:

1. A woman's bare midriff garment, comprising:

(a) an outer shell supported about the shoulders of the wearer, said outer shell handing freely from the shoulders and downward from the armpits, said shell lying across the breasts of the wearer and hanging vertically downward thereform; and (b) an inverted substantially frusto-conical segment having top and bottom elliposidial cross-sections defining a first base end and a second base end, said first base end being smaller than said second base end, the edge of said first base end including an elastic means adapted for the engagement of the torso of the wearer at the top of the rib cage but beneath the bottom of the breasts, the edge of said second base end defining a hanging hem near the bottom of the rib cage, said hem integrally secured to the lower edge of said downwardly hanging portion of said outer shell, said hem in substantially vertical alignment with that portion of said outer shell hanging downward from the armpits of the wearer.

whereby a bare midriff garment in the nature of a tank top is thereby formed, such garment affording to the wearer a stylish garment while preserving the wearer's modesty in the event of vigorous activity which, absent said elastic means for engagement of the upper rib cage, might bring about an undesirable exposure of the wearer's breasts.

2. The garment as recited in claim 1 in which the upper area of said outer shell follows substantially the neckline of the wearer, thereby creating a crew-neck neckline.

3. The garment as recited in claim 1 in which the upper area of said outer shell follows substantially the neckline of the wearer, thereby creating a tee-shirt like neckline.

4. The garment as recited in claim 1 in which said upper area of said outer shell forms a V-neckline.

5. The garment as recited in claim 1 in which said outer shell is supported about the shoulders by a plurality of straps.

6. The garment as recited in claim 1, said garment comprising a cotton fabric.

* * * * *